US009214134B2

(12) United States Patent
Yang et al.

(10) Patent No.: US 9,214,134 B2
(45) Date of Patent: Dec. 15, 2015

(54) METHOD OF DISPLAYING IMAGE OF DISPLAY PANEL

(71) Applicant: AU Optronics Corp., Hsin-Chu (TW)

(72) Inventors: Hsueh-Yen Yang, Hsin-Chu (TW); Hong-Shen Lin, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 86 days.

(21) Appl. No.: 14/155,372

(22) Filed: Jan. 15, 2014

(65) Prior Publication Data

US 2014/0313244 A1 Oct. 23, 2014

(30) Foreign Application Priority Data

Apr. 23, 2013 (TW) ..... 102114424 A

(51) Int. Cl.
*G09G 5/02* (2006.01)
*G09G 5/10* (2006.01)
*G09G 3/20* (2006.01)

(52) U.S. Cl.
CPC ..... *G09G 5/10* (2013.01); *G09G 3/2003* (2013.01); *G09G 2300/0452* (2013.01); *G09G 2360/16* (2013.01)

(58) Field of Classification Search
CPC ..... G09G 5/10
USPC ..... 345/694
See application file for complete search history.

(56) References Cited

U.S. PATENT DOCUMENTS

2004/0234163 A1* 11/2004 Lee et al. ..... G06T 3/4092 382/298
2004/0263528 A1 12/2004 Murdoch
2010/0118045 A1 5/2010 Brown Elliott

* cited by examiner

*Primary Examiner* — Charles V Hicks
(74) *Attorney, Agent, or Firm* — Winston Hsu; Scott Margo

(57) ABSTRACT

A display panel includes a plurality of pixels. Each of the pixels includes four sub-pixels. After the display panel receives luminance values of four sub-pixels of a pixel, the display panel compares a sub-pixel of the pixel with same color sub-pixels of neighboring pixels. If a luminance value of the same color sub-pixel of neighboring pixel is greater than the luminance value of the sub-pixel by a predetermined threshold, the luminance value of the sub-pixel of the pixel is reduced.

9 Claims, 6 Drawing Sheets

METHOD OF DISPLAYING IMAGE OF DISPLAY PANEL

BACKGROUND

1. Technical Field

The disclosure is related to a method of displaying image, and more particularly, to a method of displaying image to a display panel and adjusting luminance intensity of a plurality of sub-pixels to reduce bright lines in the display panel.

2. Description of the Prior Art

Liquid Crystal Display (LCD) and light emitting diode (LED) display are portable, power efficient and have no radiation, therefore, it is a preferred display to be used in portable devices such as Multimedia players, mobile phones, personal digital assistants (PDA), computer monitors or flat-screen TVs and other electronic products. While an organic light emitting diode (OLED) display has the advantage of natural light emission, wide viewing angle, high contrast, low operating voltage, short response time, dynamic color, and simple manufacturing process with small and thin circuitry. It can be seen that OLED displays will be able to replace LCDs. OLED is a light-emitting diode in which the emissive electroluminescent layer is a film of organic compound which emits light in response to an electric current. At the boundary between the emissive and the conductive layers, electrons find electron holes. When an electron finds an electron hole, the electron fills the hole. The electron then gives up energy in the form of a photon of light.

To improve the luminous efficiency, a white element is proposed to create a four color display panel. Unlike the three color (red, green and blue) display panel, each pixel of the four color display includes a red, a green, a blue and a white sub-pixel. When a color image is displayed beside a white image, there is a large visual contrast between the color image and the white image. The large visual contrast will cause the formation of bright lines that reduces the display quality.

SUMMARY

An embodiment of a method of displaying image of a display panel is disclosed. The display panel has a plurality of pixels with each pixel having a first sub-pixel, a second sub-pixel, and a fourth sub-pixel. The method comprises receiving luminance values of a first sub-pixel, a second sub-pixel, and a fourth sub-pixel of a pixel four and if a luminance value of a first sub-pixel of a pixel two is at least a second predetermined threshold value substantially more than the luminance value of the first sub-pixel of the pixel four having the pixel two be a pixel on a column next to and a row above the pixel four, a luminance value of a first sub-pixel of a pixel five is at least the second predetermined threshold value substantially more than the luminance value of the first sub-pixel of the pixel four having the pixel five be a pixel on the column next to and a same row as the pixel four, a luminance value of a first sub-pixel of a pixel eight is at least the second predetermined threshold value substantially more than the luminance value of the first sub-pixel of the pixel four having the pixel eight be a pixel on the column next to and a row below the pixel four, a luminance value of a second sub-pixel of a pixel one is at least a third predetermined threshold value substantially more than the luminance value of a second sub-pixel of the pixel four having the pixel one be a pixel on a same column as and the row above the pixel four, and/or a luminance value of a second sub-pixel of a pixel seven is at least the third predetermined threshold value substantially more than the luminance value of the second sub-pixel of the pixel four having the pixel seven be a pixel on the same column as and the row below the pixel four, controlling the fourth sub-pixel of the pixel four to display an image with a luminance value substantially less than the luminance value of the fourth sub-pixel of the pixel four.

Another embodiment of the method of displaying image of the display panel is disclosed. The display panel has a plurality of pixels with each pixel having a first sub-pixel, a second sub-pixel, and a fourth sub-pixel. The method comprises receiving luminance values of a first sub-pixel, a second sub-pixel, and a fourth sub-pixel of a pixel four and if a luminance value of a fourth sub-pixel of a pixel zero having the pixel zero be a pixel on a column before and a row above the pixel four, a fourth sub-pixel of a pixel three having the pixel three be a pixel on the column before and a same row as the pixel four, and a fourth sub-pixel of a pixel six having the pixel six be a pixel on the column before and a row below the pixel four are not at least a first predetermined threshold value substantially more than the luminance value of the fourth sub-pixel of the pixel four, but a luminance value of a first sub-pixel of a pixel two is at least a second predetermined threshold value substantially more than the luminance value of the first sub-pixel of the pixel four having the pixel two be a pixel on a column after and the row above the pixel four, a luminance value of a first sub-pixel of a pixel five is at least the second predetermined threshold value substantially more than the luminance value of the first sub-pixel of the pixel four having the pixel five be a pixel on the column after and the same row as the pixel four, a luminance value of a first sub-pixel of a pixel eight is at least the second predetermined threshold value substantially more than the luminance value of the first sub-pixel of the pixel four having the pixel eight be a pixel on the column after and the row below the pixel four, a luminance value of a second sub-pixel of a pixel one is at least a third predetermined threshold value substantially more than the luminance value of the second sub-pixel of the pixel four having the pixel one be a pixel on a same column as and the row above the pixel four, and/or a luminance value of a second sub-pixel of a pixel seven is at least the third predetermined threshold value substantially more than the luminance value of the second sub-pixel of the pixel four having the pixel seven be a pixel on the same column as and the row below the pixel four, controlling the fourth sub-pixel of the pixel four to display an image with a luminance value substantially less than the luminance value of the fourth sub-pixel of the pixel four.

Another embodiment of the method of displaying image of the display panel is disclosed. The display panel has a plurality of pixels with each pixel having a first sub-pixel, a second sub-pixel, and a fourth sub-pixel. The method comprises receiving luminance values of a first sub-pixel, a second sub-pixel and a fourth sub-pixel of a pixel four and if a luminance value of a fourth sub-pixel of a pixel zero having the pixel zero be a pixel on a column next to and a row above the pixel four, a fourth sub-pixel of a pixel three having the pixel three be a pixel on the column next to and a same row as the pixel four, and/or a fourth sub-pixel of a pixel six having the pixel six be a pixel on the column next to and a row below the pixel four is at least a first predetermined threshold value substantially more than the luminance value of the fourth sub-pixel of the pixel four, controlling the first sub-pixel of the pixel four to display an image with a luminance value substantially less than the luminance value of the first sub-pixel of the pixel four, and controlling the second sub-pixel of the pixel four to display an image with a luminance value substantially less than the luminance value of the second sub-pixel of the pixel four.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
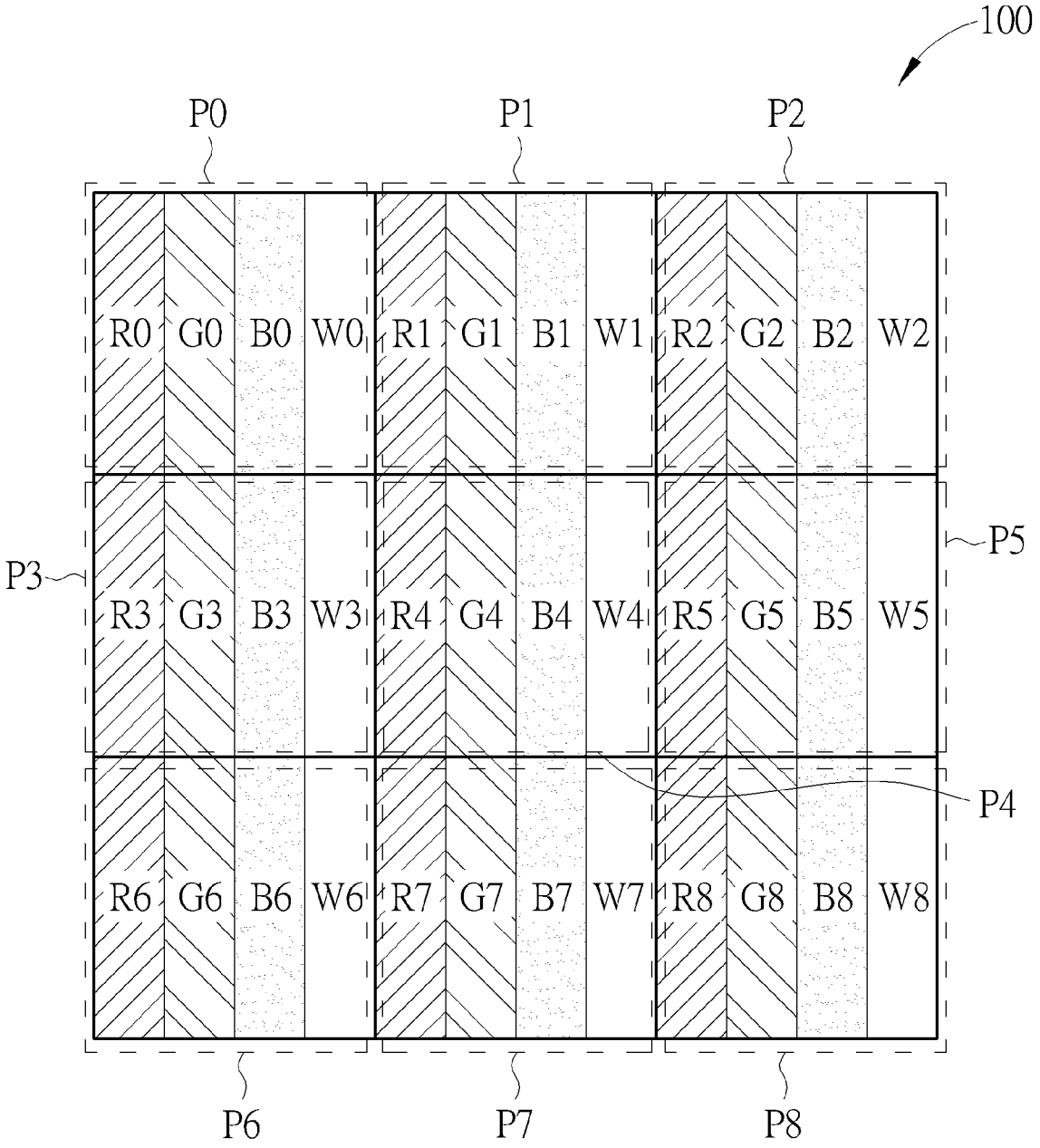
FIG. 1 illustrates an embodiment of a display panel according to the present invention.

Please refer to FIG. 1. FIG. 1 illustrates an embodiment of a display panel 100 according to the present invention. The display panel 100 comprises a plurality of pixels P0 to P8 (or namely first to ninth pixels). A pixel zero P0 (or namely first pixel) has a first sub-pixel R0, a second sub-pixel G0, a third sub-pixel B0, and a fourth sub-pixel W0. The first sub-pixel R0 can be a red sub-pixel. The second sub-pixel G0 can be a green pixel. The third sub-pixel B0 can be a blue sub-pixel. The fourth sub-pixel W0 can be a white sub-pixel (or namely transparent sub-pixel). A pixel one P1 (or namely second pixel) has a first sub-pixel R1, a second sub-pixel G1, a third sub-pixel B1, and a fourth sub-pixel W1. And accordingly, a pixel eight P8 (or namely ninth pixel) has a first sub-pixel R8, a second sub-pixel G8, a third sub-pixel B8, and a fourth sub-pixel W8. The plurality of pixels P0 to P8 in FIG. 1 is only part of the plurality of pixels of the display panel 100 and is not intended to limit the number of pixels in the display panel 100. In subsequent examples of the present invention, a pixel four P4 (or namely fifth pixel) shall represent a pixel that is being processed. When processing a next pixel, the next pixel would become a pixel four P4, and the current pixel four P4 would then become a respective pixel three P3 (or namely fourth pixel).

Figure 2:
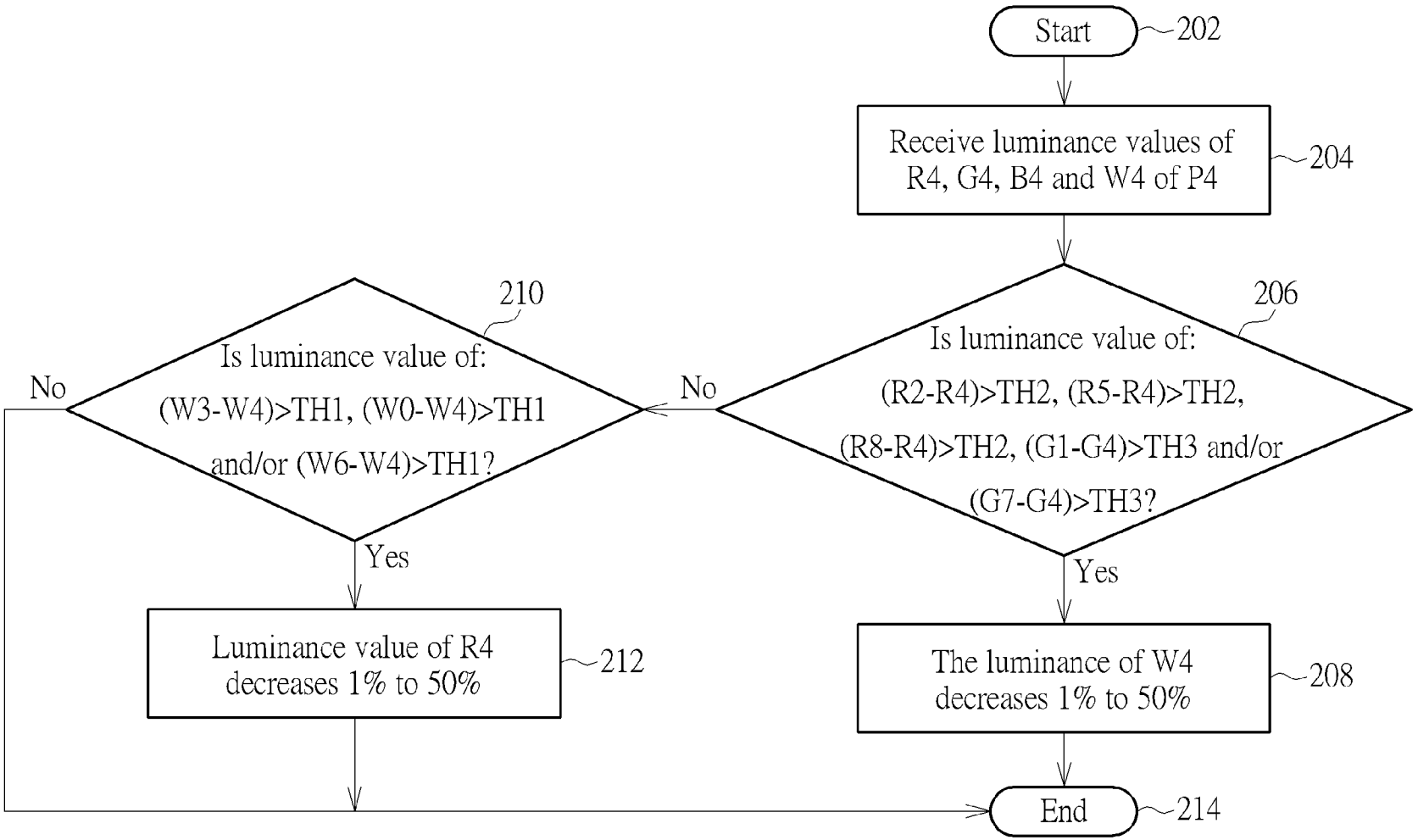
FIG. 2 illustrates a flowchart of a first embodiment of a method of displaying image of the display panel.

Please refer to FIG. 2. FIG. 2 illustrates a flowchart of a first embodiment of a method of displaying image of the display panel 100. As shown in FIG. 2, the method of displaying image of the display panel 100 may include and is not limited to the following steps:

Step 202: Start;

Step 204: Receive luminance values of a first sub-pixel R4, a second sub-pixel G4, a third sub-pixel B4 and a fourth sub-pixel W4 of the pixel four P4 (or namely fifth pixel);

Step 206: Is a luminance value of a first sub-pixel R2 of a pixel two P2 (or namely third pixel) at least a second predetermined threshold value TH2 substantially more than the luminance value of the first sub-pixel R4 of the pixel four P4 having the pixel two P2 be a pixel on a column after and a row above the pixel four P4, a luminance value of a first sub-pixel R5 of a pixel five P5 (or namely sixth pixel) at least the second predetermined threshold value TH2 substantially more than the luminance value of the first sub-pixel R4 of the pixel four P4 having the pixel five P5 be a pixel on the column after and a same row as the pixel four P4, a luminance value of the first sub-pixel R8 of the pixel eight P8 (or namely ninth pixel) at least the second predetermined threshold value TH2 substantially more than the luminance value of the first sub-pixel R4 of the pixel four P4 having the pixel eight P8 be a pixel on the column after and a row below the pixel four P4, a luminance value of the second sub-pixel G1 of the pixel one P1 (or namely second pixel) at least a third predetermined threshold value TH3 substantially more than the luminance value of the second sub-pixel G4 of the pixel four P4 having the pixel one P1 be a pixel on a same column as and the row above the pixel four P4, and/or a luminance value of a second sub-pixel G7 of a pixel seven P7 (or namely eighth pixel) at least the third predetermined threshold value TH3 substantially more than the luminance value of the second sub-pixel G4 of the pixel four P4 having the pixel seven P7 be a pixel on the same column and the row below the pixel four P4? If so, go to step 208; If not, go to step 210;

Step 208: Control the fourth sub-pixel W4 of the pixel four P4 to display an image with a luminance value substantially less than the luminance value of the fourth sub-pixel W4 of the pixel four P4; Go to step 214;

Step 210: Is a luminance value of the fourth sub-pixel W0 of the pixel zero P0 (or namely first pixel) having the pixel zero P0 be a pixel on a column before and the row above the pixel four P4, a fourth sub-pixel W3 of the pixel three P3 having the pixel three be a pixel on the column before and the same row as the pixel four P4, and/or a fourth sub-pixel WE of a pixel six P6 (or namely seventh pixel) having the pixel six P6 be a pixel on the column before and the row below the pixel four P4 at least a first predetermined threshold value TH1 substantially more than the luminance value of the fourth sub-pixel W4 of the pixel four P4? If so, go to step 212; If not, go to step 214;

Step 212: Control the first sub-pixel R4 of the pixel four P4 to display an image with the luminance value substantially less than the luminance value of the first sub-pixel R4 of the pixel four P4, and control the second sub-pixel G4 of the pixel four P4 to display an image with the luminance value substantially less than the luminance value of the second sub-pixel G4 of the pixel four P4; Go to step 214;

Step 214: End.

For the plurality of pixels P0 to P8, a plurality of first sub-pixels R0 to R8 are red sub-pixels, a plurality of second sub-pixels G0 to G8 are green sub-pixels, a plurality of third sub-pixels B0 to B8 are blue sub-pixels, and a plurality of fourth sub-pixels W0 to W8 are white sub-pixels. The colors of a first sub-pixel, a second sub-pixel, a third sub-pixel and a fourth sub-pixel may be interchanged or may be of other colors. Each of the plurality of pixels P0 to P8 as shown in FIG. 1 comprises of a red sub-pixel, green sub-pixel, a blue sub-pixel and a white sub-pixel and is arranged sequentially from left to right. However, the arrangement of the plurality of sub-pixels in each pixel is not limited to the arrangement presented.

Step 206 determines if at least one of the luminance values of the first sub-pixels R2, R5 and R8 has at least the second threshold value TH2 substantially more than the luminance value of the first sub-pixel R4 of the pixel four P4 or if at least one of the luminance values of the second sub-pixels G1 and G7 has at least the third threshold value TH3 substantially more than the luminance value of the second sub-pixel G4 of the pixel four P4. If so, the luminance value of the fourth sub-pixel W4 of the pixel four P4 is substantially reduced by 1% to 50% to display lower brightness.

Step 210 determines if at least one of the luminance values of the fourth sub-pixels W0, W3 and WE has at least the first threshold value TH1 substantially more than the luminance value of the fourth sub-pixel W4 of the pixel four P4. If so, the luminance values of the first sub-pixel R4 and the second sub-pixel G4 of the pixel four P4 are substantially reduced by 1% to 50% to display lower brightness.

Since a human eye is most sensitive to color green followed by color red, the present invention reduces the luminance value as a means to compensate for a large difference in the brightness between sub-pixels of the same color of adjacent pixels which may result to appearance of a bright line during display. For example, if the red sub-pixel of at least one of the pixel two P2 (or namely third pixel), the pixel five P5 (or namely sixth pixel) and the pixel eight P8 (or namely ninth pixel) has a luminance value at least the second threshold value TH2 substantially more than the red sub-pixel of the pixel four P4 (or namely fifth pixel) and/or at least one of the second sub-pixels G1 and G7 has a luminance value at least the third threshold value TH3 substantially more than the second sub-pixel G4, a bright line will appear. The first embodiment can reduce the brightness of the white sub-pixel of the pixel four P4 (or namely fifth pixel) and lessen color intensity difference between the pixel four P4 (or namely fifth pixel) and adjacent pixels, such as the pixel one P1 (or namely second pixel), the pixel two P2 (or namely third pixel), the pixel five P5 (or namely sixth pixel), the pixel seven P7 (or namely eighth pixel) and the pixel eight P8 (or namely ninth pixel), thereby eliminating the bright line.

Figure 3:
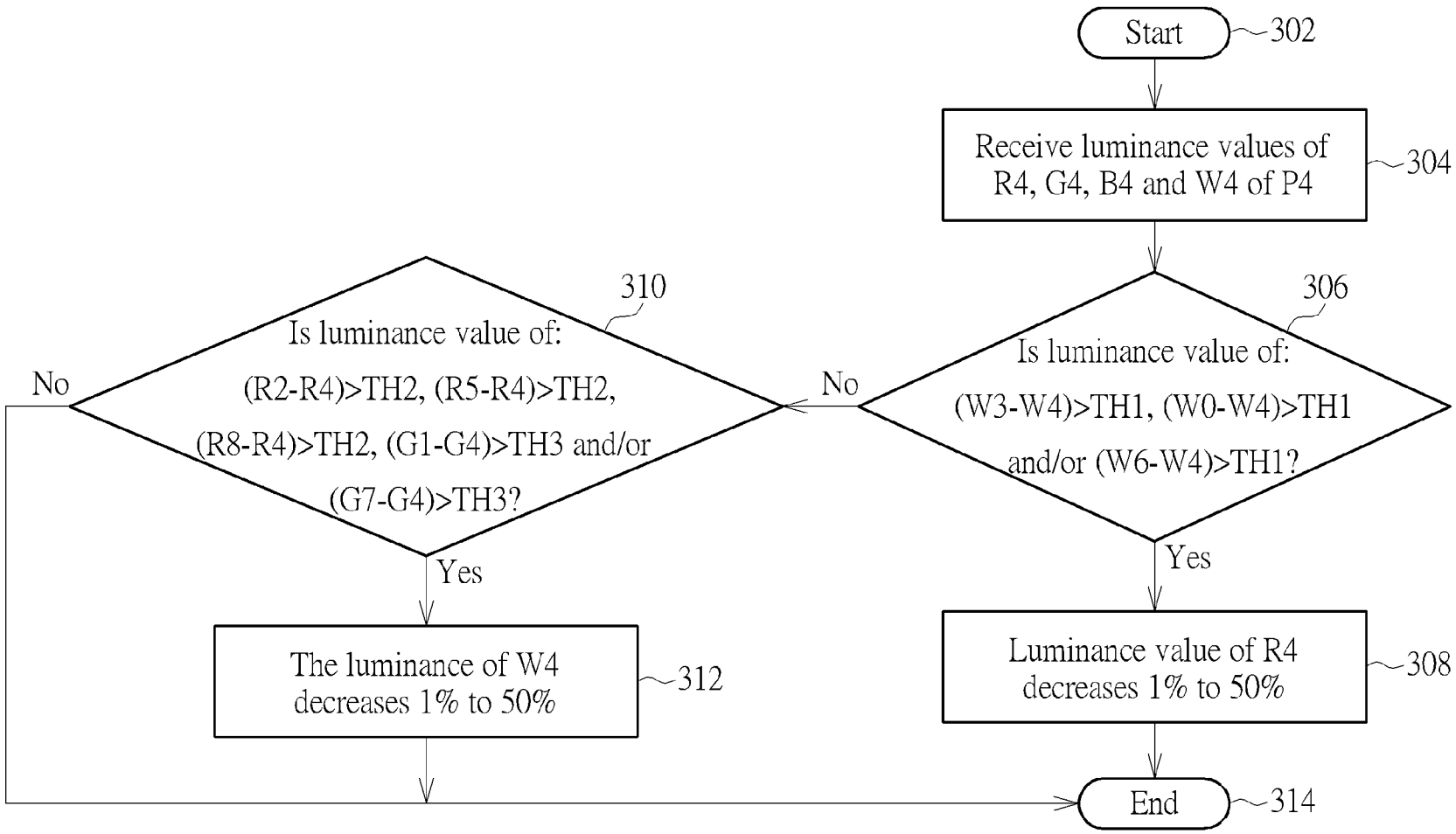
FIG. 3 illustrates a flowchart of a second embodiment of the method of displaying image of the display panel.

Please refer to FIG. 3. FIG. 3 illustrates a flowchart of a second embodiment of the method of displaying image of the display panel 100. As shown in FIG. 3, the method of displaying image of the display panel 100 may include and is not limited to the following steps:

Step 302: Start;

Step 304: Receive the luminance values of the first sub-pixel R4, the second sub-pixel G4, the third sub-pixel B4 and the fourth sub-pixel W4 of the pixel four P4 (or namely fifth pixel);

Step 306: Is the luminance value of the fourth sub-pixel W0 of the pixel zero P0 (or namely first pixel) having the pixel zero P0 be the pixel on the column before and the row above the pixel four P4, the fourth sub-pixel W3 of the pixel three P3 (or namely fourth pixel) having the pixel three be the pixel on the column before and the same row as the pixel four P4, and the fourth sub-pixel WE of the pixel six P6 (or namely seventh pixel) having the pixel six P6 be the pixel on the column before and the row below the pixel four P4 at least the first predetermined threshold value TH1 substantially more than the luminance value of the fourth sub-pixel W4 of the pixel four P4? If so, go to step 308; If not, go to step 310;

Step 308: Control the first sub-pixel R4 of the pixel four P4 to display an image with the luminance value substantially less than the luminance value of the first sub-pixel R4 of the pixel four P4, and control the second sub-pixel G4 of the pixel four P4 to display an image with the luminance value substantially less than the luminance value of the second sub-pixel G4 of the pixel four P4; Go to step 314;

Step 310: Is the luminance value of the first sub-pixel R2 of the pixel two P2 at least the second predetermined threshold value TH2 substantially more than the luminance value of the first sub-pixel R4 of the pixel four P4 having the pixel two P2 (or namely third pixel) be the pixel on the column after and the row above the pixel four P4, the luminance value of the first sub-pixel R5 of the pixel five P5 at least the second predetermined threshold value TH2 substantially more than the luminance value of the first sub-pixel R4 of the pixel four P4 having the pixel five P5 (or namely sixth pixel) be the pixel on the column after and the same row as the pixel four P4, the luminance value of the first sub-pixel R8 of the pixel eight P8 (or namely ninth pixel) at least the second predetermined threshold value TH2 substantially more than the luminance value of the first sub-pixel R4 of the pixel four P4 having the pixel eight P8 be the pixel on the column after and the row below the pixel four P4, the luminance value of the second sub-pixel G1 of the pixel one P1 at least the third predetermined threshold value TH3 substantially more than the luminance value of the second sub-pixel G4 of the pixel four P4 having the pixel one P1 be the pixel on the same column as and the row above the pixel four P4, and/or the luminance value of the second sub-pixel G7 of the pixel seven P7 (or namely eighth pixel) at least the third predetermined threshold value TH3 substantially more than the luminance value of the second sub-pixel G4 of the pixel four P4 having the pixel seven P7 be the pixel on the same column as and the row below the pixel four P4? If so, go to step 312; If not, go to step 314;

Step 312: Control the fourth sub-pixel W4 of the pixel four P4 to display an image with the luminance value substantially less than the luminance value of the fourth sub-pixel W4 of the pixel four P4; Go to step 314;

Step 314: End.

As shown in FIG. 3, the pixel four P4 (or namely fifth pixel) is compared to the pixel zero P0 (or namely first pixel), the pixel three P3 (or namely fourth pixel) and the pixel six P6 (or namely seventh pixel) using their corresponding fourth sub-pixels. If the luminance values of the fourth sub-pixels W0, W3 and W6 are not at least the first threshold value TH1 substantially more than the luminance value of the fourth pixel W4 of the pixel four P4, then proceed with the pixel four P4 being compared with the pixel two P2 (or namely third pixel), the pixel five P5 (or namely sixth pixel) and the pixel eight P8 (or namely ninth pixel) using their corresponding first sub-pixels and/or the pixel four P4 being compared with the pixel one P1 (or namely second pixel) and the pixel seven P7 (or namely eighth pixel) using their corresponding second sub-pixels. The effect of the method shown in FIG. 3 is similar to the effect of the method shown in FIG. 2, therefore is no longer described in detail for brevity. In step 308, the luminance values of the first sub-pixel R4 and the second sub-pixel G4 of pixel four P4 can be substantially reduced by 1% to 50%. In step 312, the luminance value of the fourth sub-pixel W4 can be substantially reduced by 1% to 50%.

Figure 4:
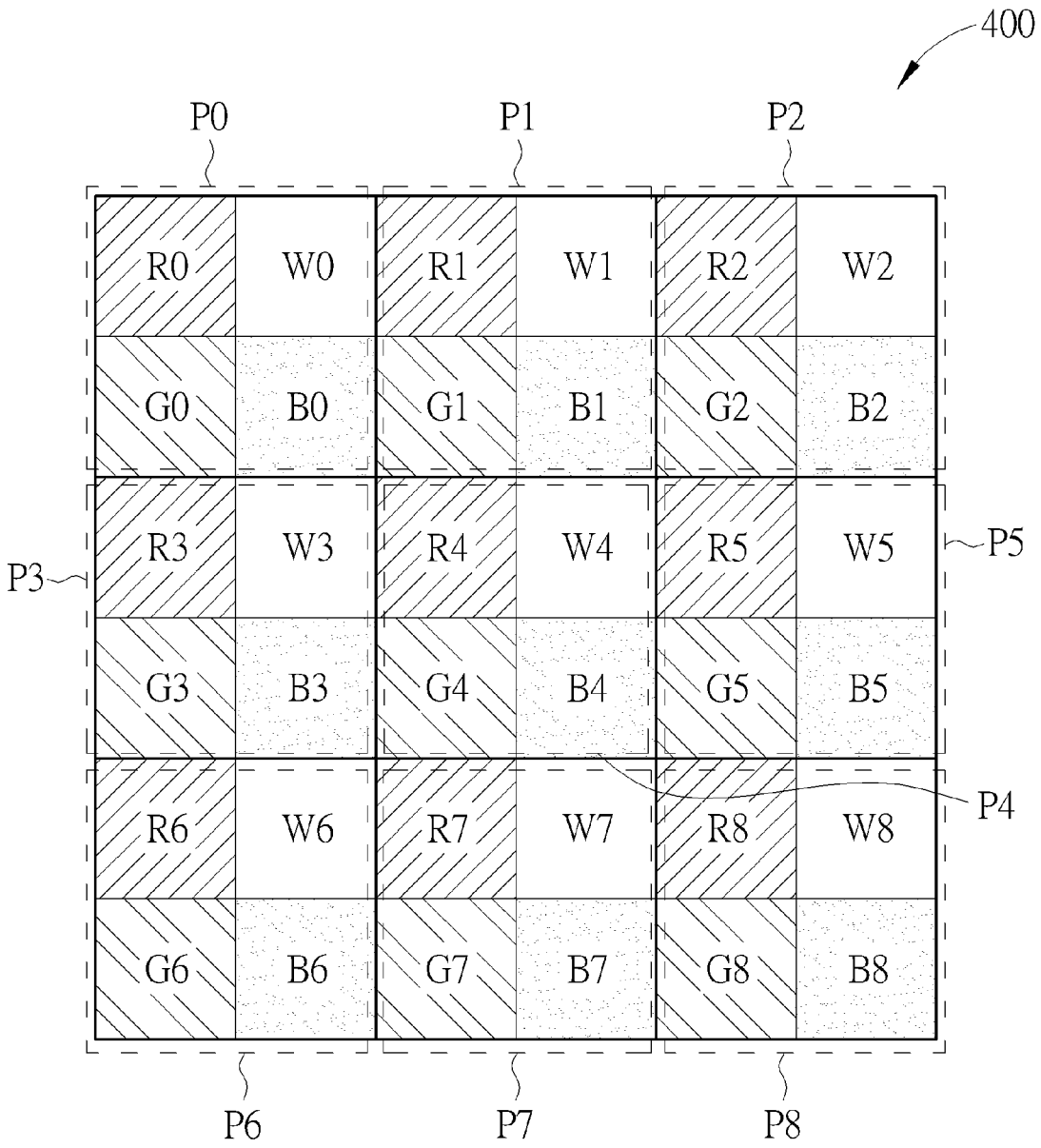
FIG. 4 illustrates another embodiment of the display panel according to the present invention.

Please refer to FIG. 4. FIG. 4 illustrates another embodiment of a display panel 400 according to the present invention. The display panel 400 comprises a plurality of pixels P0 to P8 (or namely first to eighth pixels). The difference between the display panel 400 and the display panel 100 is that for the display panel 100, a red sub-pixel, a green sub-pixel, a blue sub-pixel and a white sub-pixel are arranged sequentially from left to right as shown in FIG. 1. Whereas, for the display panel 400, a red sub-pixel, a green sub-pixel, a blue sub-pixel and a white sub-pixel of the plurality of pixels P0 to P8 are arranged in a two by two matrix. The two by two matrix has a first row first column as the red sub-pixel, a first row second column as the white sub-pixel, a second row first column as the green sub-pixel and a second row second column as the blue sub-pixel.

Figure 5:
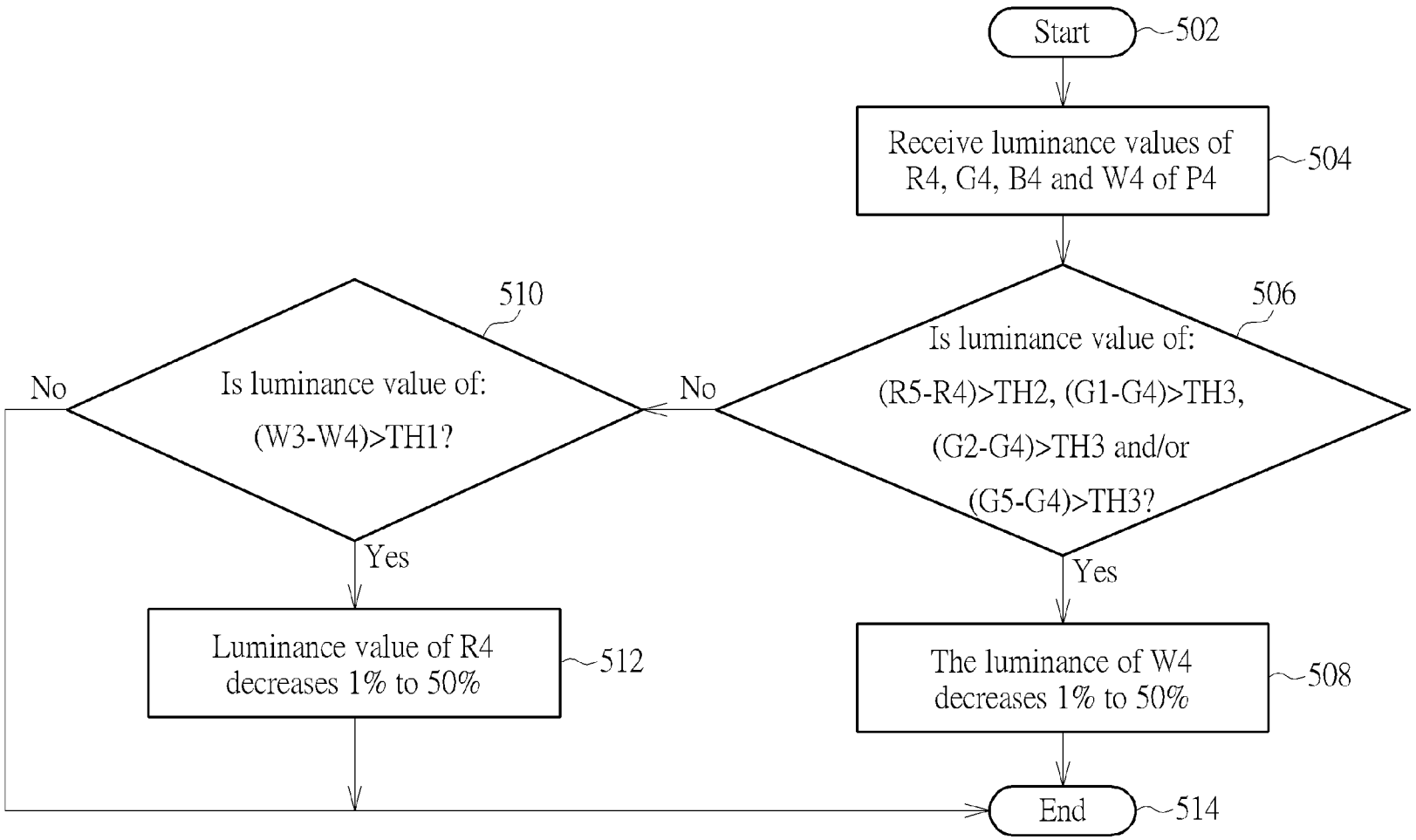
FIG. 5 illustrates a flowchart of a third embodiment of the method of displaying image of the display panel.

Please refer to FIG. 5. FIG. 5 illustrates a flowchart of a third embodiment of the method of displaying image of the display panel 400. As shown in FIG. 5, the method of displaying image of the display panel 400 may include and is not limited to the following steps:

Step 502: Start;

Step 504: Receive the luminance values of the first sub-pixel R4, the second sub-pixel G4, the third sub-pixel B4 and the fourth sub-pixel W4 of the pixel four P4 (or namely fifth pixel);

Step 506: Is the luminance value of the first sub-pixel R5 of the pixel five P5 (or namely sixth pixel) at least the second predetermined threshold value TH2 substantially more than the luminance value of the first sub-pixel R4 of the pixel four P4 having the pixel five be the pixel on the column after and the same row as the pixel four P4 (or namely fifth pixel), the luminance value of the second sub-pixel G1 of the pixel one P1 at least the third predetermined threshold value TH3 substantially more than the luminance value of the second sub-pixel G4 of the pixel four P4 having the pixel one P1 (or namely second pixel) be a pixel on the same column as and the row above the pixel four P4 (or namely fifth pixel), the luminance value of a second sub-pixel G2 of the pixel two P2 (or namely third pixel) at least the third predetermined threshold value TH3 substantially more than the luminance value of the second sub-pixel G4 of the pixel four P4 having the pixel two P2 be the pixel on the column after and the row above the pixel four P4, and/or the luminance value of a second sub-pixel G5 of the pixel five P5 (or namely sixth pixel) at least the third predetermined threshold value TH3 substantially more than the luminance value of the second sub-pixel G4 of the pixel four P4 having the pixel five P5 be the pixel on the column after and the same row as the pixel four P4? If so, go to step 508; If not, go to step 510;

Step 508: Control the fourth sub-pixel W4 of the pixel four P4 to display an image with a luminance value substantially less than the luminance value of the fourth sub-pixel W4 of the pixel four P4; Go to step 514;

Step 510: Is the luminance value of the fourth sub-pixel W3 of the pixel three P3 (or namely fourth pixel) at least the first predetermined threshold value TH1 substantially more than the luminance value of the fourth sub-pixel W4 of the pixel four P4 having the pixel three P3 be a pixel on the column before and the same row as the pixel four P4? If so, go to step 512; If not, go to step 514;

Step 512: Control the first sub-pixel R4 of the pixel four P4 to display an image with a luminance value substantially less than the luminance value of the first sub-pixel R4 of the pixel four P4, and control the second sub-pixel G4 of the pixel four P4 to display an image with the luminance value substantially less than the luminance value of the second sub-pixel G4 of the pixel four P4;

Step 514: End.

Since the sub-pixel positioning used in the methods shown in FIG. 2 and FIG. 5 are different, the comparison approach of the adjacent pixels is different. For the method shown in FIG. 5, in Step 506, the pixel four P4 (or namely fifth pixel) is compared to the pixel five P5 (or namely sixth pixel) by comparing the respective first sub-pixels and/or the pixel four P4 is compared to the pixel one P1 (or namely second pixel), the pixel two P2 (or namely third pixel) and the pixel five P5 (or namely sixth pixel) by comparing the respective second sub-pixels. If the luminance value of the first sub-pixel R5 of the pixel five P5 is not at least the second predetermined threshold value TH2 substantially more than the luminance value of the first sub-pixel R4 of the pixel four P4 and the luminance values of the second sub-pixel G1 of the pixel one P1, the second sub-pixel G2 of the pixel two P2, and the second sub-pixel G5 of the pixel five P5 are not at least the third predetermined threshold value TH3 substantially more than the luminance value of the second sub-pixel G4 of the pixel four P4, then proceed to step 510. In step 510, the fourth sub-pixel W3 of the pixel three P3 (or namely fourth pixel) is compared to the fourth sub-pixel W4 of the pixel four P4 to see if the luminance value fourth sub-pixel W3 of the pixel three P3 is at least the first predetermined threshold value substantially more than the luminance value of the fourth sub-pixel W4 of the pixel four P4. In step 508, the luminance value of the fourth sub-pixel W4 can be substantially reduced by 1% to 50%. In step 512, the luminance values of the first sub-pixel R4 and the second sub-pixel G4 of pixel four P4 can be substantially reduced by 1% to 50%.

Figure 6:
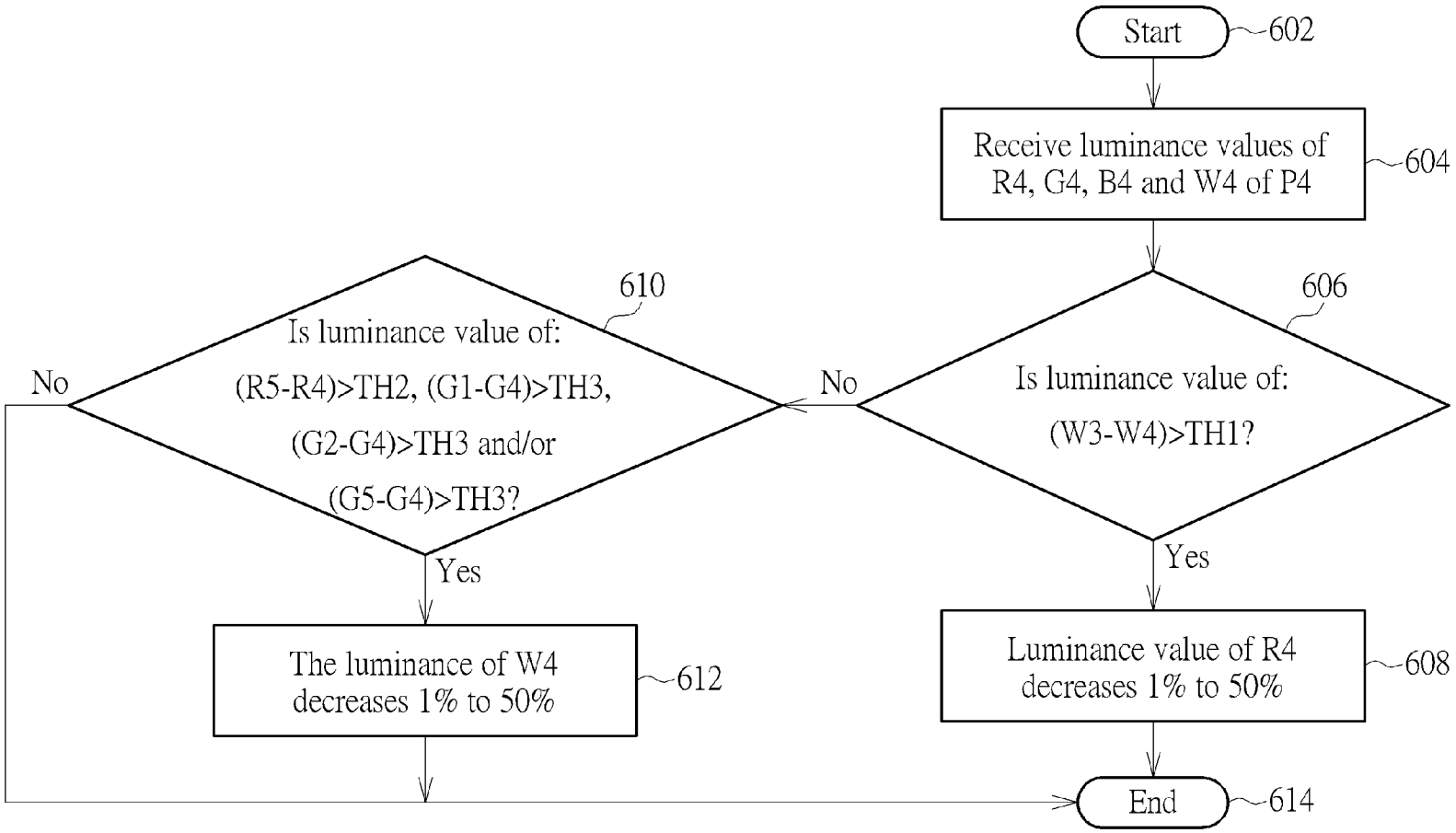
FIG. 6 illustrates a flowchart of a fourth embodiment of the method of displaying image of the display panel.

Please refer to FIG. 6. FIG. 6 illustrates a flowchart of a fourth embodiment of the method of displaying image of the display panel 400. As shown in FIG. 6, the method of displaying image of the display panel 400 may include and is not limited to the following steps:

Step 602: Start;

Step 604: Receive the luminance values of the first sub-pixel R4, the second sub-pixel G4, the third sub-pixel B4 and the fourth sub-pixel W4 of the pixel four P4 (or namely fifth pixel);

Step 606: Is the luminance value of the fourth sub-pixel W3 of the pixel three P3 (or namely fourth pixel) at least the first predetermined threshold value TH1 substantially more than the luminance value of the fourth sub-pixel of the pixel four P4 (or namely fifth pixel) having the pixel three be a pixel on the column before and the same row as the pixel four P4? If so, go to step 608; If not, go to step 610;

Step 608: Control the first sub-pixel R4 of the pixel four P4 to display an image with a luminance value substantially less than the luminance value of the first sub-pixel R4 of the pixel four P4, and control the second sub-pixel G4 of the pixel four P4 to display an image with the luminance value substantially less than the luminance value of the second sub-pixel G4 of the pixel four P4; Go to step 614;

Step 610: Is the luminance value of the first sub-pixel R5 of the pixel five P5 (or namely sixth pixel) at least the second predetermined threshold value TH2 substantially more than the luminance value of the first sub-pixel R4 of the pixel four P4 having the pixel five P5 be the pixel on the column after and the same row as the pixel four P4, the luminance value of the second sub-pixel G1 of the pixel one P1 (or namely second pixel) at least the third predetermined threshold value TH3 substantially more than the luminance value of the second sub-pixel G4 of the pixel four P4 having the pixel one P1 be a pixel on the same column as and the row above the pixel four P4, the luminance value of the second sub-pixel G2 of the pixel two P2 (or namely third pixel) at least the third predetermined threshold value TH3 substantially more than the luminance value of the second sub-pixel G4 of the pixel four P4 having the pixel two P2 be the pixel on the column after and the row above the pixel four P4, and/or the luminance value of the second sub-pixel G5 of the pixel five P5 at least the second predetermined threshold value TH2 substantially more than the luminance value of the second sub-pixel G4 of the pixel four P4 having the pixel five P5 be the pixel on the column after and the same row as the pixel four P4? If so, go to step 612; If not, go to step 614;

Step 612: Control the fourth sub-pixel W4 of the pixel four P4 to display an image with a luminance value substantially less than the luminance value of the fourth sub-pixel W4 of the pixel four P4;

Step 614: End.

For the method shown in FIG. 6, step 606 first compare the fourth sub-pixels of the pixel four P4 (or namely fifth pixel) and the pixel three P3 (or namely fourth pixel). If the luminance value of the fourth sub-pixel W3 of the pixel three P3 is not is at least the first predetermined threshold value TH1 substantially more than the luminance value of the fourth sub-pixel W4 of the pixel four P4, then the method will proceed to compare the first sub-pixels of the pixel four P4 and the pixel five P5 (or namely sixth pixel) and/or the second sub-pixels of the pixel one P1 (or namely second pixel), the pixel two P2 (or namely third pixel) and the pixel five P5 (or namely sixth pixel) with the second sub-pixel G4 of the pixel four P4. Furthermore, in step 608, the luminance values of the first sub-pixel R4 and the second sub-pixel G4 of pixel four P4 can be substantially reduced by 1% to 50%. In step 612, the luminance value of the fourth sub-pixel W4 can be substantially reduced by 1% to 50%.

The embodiments of the present invention can adjust the luminance values of the plurality of sub-pixels in order to reduce the bright line effect on display panels.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of displaying an image on a display panel, the display panel having a plurality of pixels, each pixel having a first sub-pixel, a second sub-pixel, and a third sub-pixel, the method comprising:

receiving luminance values of a first sub-pixel, a second sub-pixel, and a third sub-pixel of a first pixel; and when at least one of the following conditions occurs, a luminance value of a first sub-pixel of a second pixel disposed on a column next to and a row above the first pixel is at least a predetermined threshold value more than the luminance value of the first sub-pixel of the first pixel, a luminance value of a first sub-pixel of a third pixel disposed on the column next to and a same row as the first pixel is at least the predetermined threshold value more than the luminance value of the first sub-pixel of the first pixel, a luminance value of a first sub-pixel of a fourth pixel disposed on the column next to and a row below the first pixel is at least the predetermined threshold value more than the luminance value of the first sub-pixel of the first pixel, a luminance value of a second sub-pixel of a fifth pixel disposed on a same column as and the row above the first pixel is at least another predetermined threshold value more than the luminance value of a second sub-pixel of the first pixel, and a luminance value of a second sub-pixel of a sixth pixel disposed on the same column as and the row below the first pixel is at least the another predetermined threshold value more than the luminance value of the second sub-pixel of the first pixel, reducing the luminance value of the third sub-pixel of the first pixel.

2. The method in claim 1, wherein:

the first sub-pixel of the first pixel, the first sub-pixel of the second pixel, the first sub-pixel of the third pixel, and the first sub-pixel of the fourth pixel are red sub-pixels;

the second sub-pixel of the first pixel, the second sub-pixel of the fifth pixel, and the second sub-pixel of the sixth pixel are green sub-pixels;

the third sub-pixel of the first pixel is a white sub-pixel;

the first pixel further has a blue sub-pixel; and the first sub-pixel of the first pixel, the second sub-pixel of the first pixel, the blue sub-pixel, and the white sub-pixel are arranged sequentially along a first direction.

3. The method in claim 1, wherein reducing the luminance value of the third sub-pixel of the first pixel is reducing the luminance value of the third sub-pixel of the first pixel by 1% to 50%.

4. A method of displaying an image on a display panel, the display panel having a plurality of pixels, each pixel having a first sub-pixel, a second sub-pixel, and a third sub-pixel, the method comprising:

receiving luminance values of a first sub-pixel, a second sub-pixel, and a third sub-pixel of a first pixel; and when at least one of the following conditions occurs, a luminance value of a third sub-pixel of a second pixel disposed on a column before and a row above the first pixel, a third sub-pixel of a third pixel disposed on the column before and a same row as the first pixel, and a third sub-pixel of a fourth pixel disposed on the column before and a row below the first pixel are not at least a first predetermined threshold value more than the luminance value of the third sub-pixel of the first pixel, but a luminance value of a first sub-pixel of a fifth pixel disposed on a column after and the row above the first pixel is at least a second predetermined threshold value more than the luminance value of the first sub-pixel of the first pixel, a luminance value of a first sub-pixel of a sixth pixel disposed on the column after and the same row as the first pixel is at least the second predetermined threshold value more than the luminance value of the first sub-pixel of the first pixel, a luminance value of a first sub-pixel of a seventh pixel disposed on the column after and the row below the first pixel is at least the second predetermined threshold value more than the luminance value of the first sub-pixel of the first pixel, a luminance value of a second sub-pixel of a eighth pixel disposed on a same column as and the row above the first pixel is at least a third predetermined threshold value more than the luminance value of the second sub-pixel of the first pixel, and a luminance value of a second sub-pixel of a ninth pixel disposed on the same column as and the row below the first pixel is at least the third predetermined threshold value more than the luminance value of the second sub-pixel of the first pixel, reducing the luminance value of the third sub-pixel of the first pixel.

5. The method in claim 4, wherein:

the first sub-pixel of the fifth pixel, the first sub-pixel of the first pixel, the first sub-pixel of the sixth pixel, and the first sub-pixel of the seventh pixel are red sub-pixels;

the second sub-pixel of the eighth pixel, the second sub-pixel of the first pixel, and the second sub-pixel of the ninth pixel are green sub-pixels;

the third sub-pixel of the second pixel, the third sub-pixel of the third pixel, the third sub-pixel of the first pixel, and the third sub-pixel of the fourth pixel are white sub-pixels;

the first pixel further has a blue sub-pixel; and the first sub-pixel of the first pixel, the second sub-pixel of the first pixel, the blue sub-pixel, and the third sub-pixel of the first pixel are arranged sequentially along a first direction.

6. The method in claim 4, wherein reducing the luminance value of the third sub-pixel of the first pixel is reducing the luminance value of the third sub-pixel of the first pixel by 1% to 50%.

7. A method of displaying an image on a display panel, the display panel having a plurality of pixels, each pixel having a first sub-pixel, a second sub-pixel, and a third sub-pixel, the method comprising:

receiving luminance values of a first sub-pixel, a second sub-pixel and a third sub-pixel of a first pixel-few; and when at least one of the following conditions occurs, a luminance value of a third sub-pixel of a second pixel disposed on a column next to and a row above the first pixel is at least a first predetermined threshold value more than the luminance value of the third sub-pixel of the first pixel, a third sub-pixel of a third pixel disposed on the column next to and a same row as the first pixel-few is at least the first predetermined threshold value more than the luminance value of the third sub-pixel of the first pixel, and a third sub-pixel of a fourth pixel disposed on the column next to and a row below the first pixel is at least the first predetermined threshold value more than the luminance value of the third sub-pixel of the first pixel, reducing the luminance value of the first sub-pixel of the first pixel, and reducing the luminance value of the second sub-pixel of the first pixel.

8. The method in claim 7, wherein:

the first sub-pixel of the first pixel is a red sub-pixel;

the second sub-pixel of the first pixel is a green sub-pixel;

the third sub-pixel of the second pixel, the third sub-pixel of the third pixel, the third sub-pixel of the first pixel, and the third sub-pixel of the fourth pixel are white sub-pixels;

the first pixel further has a blue sub-pixel; and the first sub-pixel of the first pixel, the second sub-pixel of the first pixel, the blue sub-pixel, and the third sub-pixel of the first pixel are arranged sequentially along a first direction.

9. The method in claim 7, wherein reducing the luminance value of the first sub-pixel of the first pixel is reducing the luminance value of the first sub-pixel of the first pixel by 1% to 50%, and reducing the luminance value of the second sub-pixel of the first pixel is reducing the luminance value of the second sub-pixel of the first pixel by 1% to 50%.

* * * * *